US005943020A

United States Patent [19]

Liebendoerfer et al.

[11] Patent Number: 5,943,020

[45] Date of Patent: Aug. 24, 1999

[54] FLAT THREE-DIMENSIONAL ANTENNA

[75] Inventors: Matthias Liebendoerfer, Basel; Ulrich Dersch, Wohlenschwil, both of Switzerland

[73] Assignee: Ascom Tech AG, Bern, Switzerland

[21] Appl. No.: 08/815,939

[22] Filed: Mar. 13, 1997

[30] Foreign Application Priority Data

Mar. 13, 1996 [CH] Switzerland ..... 667/96

[51] Int. Cl.[6] ..... H01Q 1/24

[52] U.S. Cl. ..... 343/702; 343/700 MS

[58] Field of Search ..... 343/700 MS, 702, 343/846, 829, 830

[56] References Cited

U.S. PATENT DOCUMENTS

| | | | |
|---|---|---|---|
| 4,197,544 | 4/1980 | Kaloi | 343/700 MS |
| 5,309,164 | 5/1994 | Dienes et al. | 343/700 MS |
| 5,510,802 | 4/1996 | Tsuru et al. | 343/700 MS |
| 5,541,610 | 7/1996 | Imanishi et al. | 343/702 |
| 5,657,028 | 8/1997 | Sanad | 343/700 MS |
| 5,838,280 | 11/1998 | Miyashita | 343/700 MS |

FOREIGN PATENT DOCUMENTS

| | | | |
|---|---|---|---|
| 0226390 A2 | 6/1987 | European Pat. Off. | H01Q 9/04 |
| 0637094 A1 | 2/1995 | European Pat. Off. | H01Q 9/04 |
| 2552937 | 5/1985 | France | H01Q 13/08 |
| 60-134605 | 7/1985 | Japan | H01Q 13/08 |
| 2147744 | 5/1985 | United Kingdom | H01Q 1/38 |
| 2150356 | 6/1985 | United Kingdom . | |

*Primary Examiner*—Don Wong
*Assistant Examiner*—Jennifer H. Malos

[57] ABSTRACT

A flat three-dimensional antenna is built in three planes. In the first plane is a base plate, in the second plane is a slot divider bent in a U-shape, and in the third plane is resonant structure above the slot divider. The slot divider has a middle part with a length of preferably $\lambda/4$ and two limbs of $\lambda/8$ of the same length. With the base plate the slot divider forms a $\lambda/2$ antenna slot, while the resonant structure with the slot divider defines a shorter second antenna slot. The antenna is characterized by a large bandwidth and omnidirectional radiation characteristic. Perpendicular to the base plate there is essentially no radiation. Feeding takes place preferably via a stripline which is routed between two limbs to a middle part. Impedance matching of the antenna is achieved by suitable dimensioning of the stripline. The antenna can be built equally well in air as well as in a dielectric such as a ceramic block. Several of these antennas can be combined into an ultracompact diversity antenna system.

13 Claims, 2 Drawing Sheets

FLAT THREE-DIMENSIONAL ANTENNA

BACKGROUND OF THE INVENTION

1. Field of the Invention

The present invention relates to a three-dimensional antenna suitable for wireless transmission of digital data in local area networks.

2. Description of the Background Art

In wireless communications in local area networks (LAN) new stipulations are being added to conventional requirements (such as matched input impedance, good radiation characteristic, efficiency). Thus, for example, it is desirable for the antenna or a diversity antenna system to have space on a PCMCIA card. In laptop computers with communications capacity there are horizontal plug-in slots for these cards. An antenna system integrated on a PCMCIA card should therefore radiate roughly equally well in the horizontal plane in all directions. So that an antenna can be integrated on a card of this type, it must not exceed the height allowed by standards. Therefore, it is not possible in many frequency ranges to use a simple monopole antenna for these communications.

SUMMARY OF THE INVENTION

An object of the invention is to devise a flat, compact, three-dimensional antenna which is suitable for wireless transmission of digital data in local area networks. The antenna should have a radiation pattern as omnidirectional as possible with low dependency of matching on adjacent external articles.

In a preferred embodiment, the antenna is built in three planes. In the first plane is a base plate, in the second is a slot divider bent in a U-shape, and in the third is a resonant structure. The slot divider is bent in a U-shape in the second plane so that a middle part and two side limbs are formed.

This antenna is extremely compact and radiates primarily in spatial directions which are defined by the base plate (i.e., "horizontal"). Due to the resonant structure, the antenna has an extremely large bandwidth (for example, 20% to 30%). In this way the effect of adjacent ambient articles can be kept low. The existence of a conductive base plate also supports this advantage.

Preferably the antenna is supplied by a stripline which is routed in the second plane between the two limbs and which contacts the slot divider on the middle part. The input impedance of the antenna can be matched by varying the width and length of the stripline. The stripline can for example completely fill the area between the limbs. The length of the stripline is preferably less than the length of the limbs, so that more space than is needed by the antenna is not required by the feed. However, it is also possible to make the stripline longer (i.e., to route it more or less out of the antenna in the second plane and for example to reduce the width). The antenna feed can be accomplished, depending on the embodiment, via a microstrip line or coaxial line (which is routed through the base plate).

The middle part of the slot divider for example has length $\lambda/4$ ($\lambda$=wavelength at the resonant frequency). The two limbs are then each $\lambda/8$ long. On the ends of the limbs the slot conductor is joined to the base plate. The length of the middle part can also be somewhat longer or somewhat shorter. Accordingly the antenna becomes more or less elongated.

The resonant structure is supported by (electrically conductive) flank elements on the limbs of the slot divider.

If the antenna is embedded in a dielectric medium, the mechanical support function is in principle assumed by the dielectric medium. The flank elements can then be suitably attached metal coatings for connecting the resonant structure to the slot divider. For the case in which the antenna or at least the resonant structure is to be in air, the entire antenna can in principle be implemented by bending a plate with a suitable cross-sectional pattern. The resonant structure can for example have a gap in the middle so that it is formed by two plate-shaped, mirror-symmetrical elements. The gap is unimportant in electrical terms, since there is a current node in the middle of the resonant structure anyway.

Preferably a first antenna slot formed between the base plate and slot divider is larger than a second antenna slot formed between the slot divider and resonant element. The length of the second antenna slot can be varied, the antenna bandwidth changing accordingly. In the extreme case it is possible to build an antenna with two separate resonances (dual frequency mode). Conversely, the resonances can also be brought very near one another, enabling narrow bandwidth.

The antenna may be built in different ways. It is conceivable for example that the antenna can be formed from a punched or etched sheet and soldered onto a base plate (for example, a metal-coated printed board). Between the first and second plane of the antenna there can be a dielectric. Thus, for example, the slot divider can be printed onto the top side of a suitably thick circuit board as a printed conductor structure, the base plate being formed by the metal coating on the back of the substrate. The resonant structure in the third plane can be made for example as a flat, inverted U-section (board with two flanks opposite on the end side, the flanks being soldered onto the printed conductor structures).

According to one especially preferred embodiment, the antenna is formed on a ceramic block. The resonant structure is then a metal coating on the first (top) main surface of the ceramic block. The slot divider in the second plane is represented for example by a metal coating on the narrow lateral surface of the ceramic block. The base plate can be formed by a metal coating on the second (bottom) main surface of the ceramic block or by a metal surface onto which the ceramic block is soldered. Between the two main surfaces there can be a metal-coated slot in the ceramic block in which the stripline for feeding the antenna is located. An antenna with this structure is not only extremely compact (due to the relative dielectric constant $\in_r>1$), but also very durable. It can be handled and soldered like any other electronic component (SMD=surface mounted device). Because the antenna is small, the danger of damage is prevented (no antenna projecting out of the housing).

Under certain circumstances there can be an inductance for antenna matching. It is preferably integrated in or in front of the stripline.

The antenna is also well suited for diversity reception. This relates both to space and angular diversity, often also called pattern diversity.

Sectorizing angular diversity is achieved by placement directly next to one another, which is noteworthy. This means that each of the two antennas is especially sensitive in one direction in which the other has only extremely low sensitivity. By switching or combining the two antenna feeds the performance of a receiver can be enhanced (diversity gain). For example, there is switching from one antenna to the other when the signal of the first one becomes too weak. If the antenna signals are additionally phase-shifted against one another, the sensitivity pattern can be turned in space.

To achieve space diversity, several antennas can be placed next to one another at a certain distance (for example, $\lambda/3$ to $\lambda/2$). With the antenna element described below, for example, a 3-x space diversity antenna system can be built which can be packed into a volume of $54\times28\times5.2$ mm$^3$ (which corresponds to the extension of a PCMCIA card).

The antenna is suited preferably for HIPERLAN application and hand radiotelephones (including cordless phones). The frequency ranges provided for these applications are typically above 1 GHz (for example, at 5.2 GHz in the European Telecommunications Standard HIPERLAN).

The antenna is also suited for use in an antenna array since the large bandwidth also allows matching in the vicinity of adjacent antennas.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitative of the present invention and wherein.

DETAILED DESCRIPTION OF PREFERRED EMBODIMENTS

Figure 1:
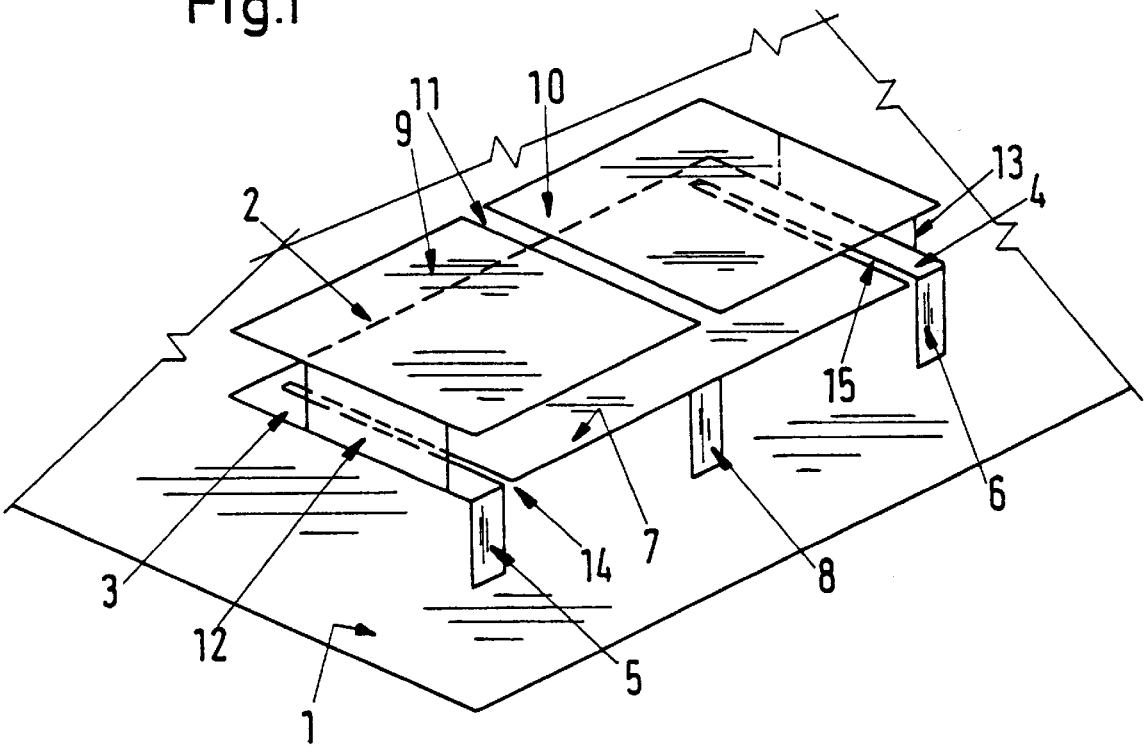
FIG. 1 shows a schematic perspective of an embodiment of the antenna in air.

FIG. 1 shows an embodiment of the antenna in air. It is built in three planes or layers. The first plane is defined by base plate 1. It can be a wall of a metal box or the metal coating on a circuit board.

In the second plane is the slot divider. It is in principle a U-shaped metal strip with middle part 2 and two limbs 3, 4. The length of middle part 2 is preferably $\lambda/4$, that of limbs 3, 4 is $\lambda/8$. The slot divider is shorted with base plate 1 on both ends of limbs 3, 4 via two legs 5, 6.

In the third plane is a resonant structure. In this example it is formed by two symmetrical plates 9, 10. They are supported by vertical side surfaces 12, 13 on the outside of bent limbs 3, 4 of the slot divider. Two plates 9, 10 are separated by gap 11. Viewed electrically, this is irrelevant since it lies in a current node. As FIG. 1 clearly shows, it conversely enables the forming of the antenna from a flat, suitably cut sheet metal section.

To feed the antenna there is for example stripline 7 which is joined via leg 8 to a coaxial connection under base plate 1. If the base plate is made as a circuit board, another microstrip line can take the place of the coaxial connection. The stripline completely fills the area formed between two limbs 3, 4 according to the necessary impedance matching (in which it is separated only by two gaps 14, 15 from limbs 3, 4).

Regarding dimensioning the following can be stated:

Two plates 9, 10 essentially cover the surface stretched by the slot divider which is bent in a U-shape. The distance between the resonant structure and the slotted divider is preferably less than the distance between the slotted divider and base plate 1. In this sense, for example, the second plane can be located at a height of 2.6 mm ($\lambda/8$) and the third plane at a height of 4.2 mm ($\lambda/20$) over the base plate (medium frequency $f_0$=6.4 GHz, $\lambda\cong4.7$ cm).

Between the resonant structure and the slot divider is an antenna slot which is bounded in length by side surfaces 12, 13. The length of this slot can be varied to fix the bandwidth. If side surfaces 12, 13 are for example the same length as limbs 3, 4, the antenna slot is the same length as middle part 2. In principle, vertical side surfaces 12, 13 can even be guided around the corner onto middle part 2. Conversely, they can also claim only a small part of limbs 3, 4 and can be placed near the ends or legs 5, 6. Accordingly then the upper antenna slot would be roughly the same size as the lower antenna slot between the slot divider and base plate 1.

In principle the antenna according to this embodiment is two bent $\lambda/2$ slots stacked on top of one another, with different slot lengths.

Impedance matching is done via dimensioning of stripline 7. In the aforementioned numerical example it has a width of for example 11 mm (0.24 $\lambda$) and a depth of for example 5.5 mm (0.12 $\lambda$). Two limbs 3, 4 each have a width for example of 0.75 mm (0.015 $\lambda$). Gap 11 is for example 1 mm ($\lambda/50$) wide. The entire antenna has a width of for example 0.28 $\lambda$ and a depth of for example of 0.14 $\lambda$.

Stripline 7 under certain circumstances can also be less wide and/or run out of the area stretched by two limbs 3, 4. In particular it is suited for feed via microstrip lines.

The antenna structure shown in FIG. 1 can be embedded partially or entirely in a dielectric medium (of course with matching of the dimensioning based on the higher relative dielectric constant $\in_r>1$). Thus, for example, the slot divider (limbs 3, 4, middle part 2) and stripline 7 can be applied to the dielectric substrate as a printed circuit structure (printed board). Base plate 1 can be provided as metal coating on the back of the substrate, legs 5, 6, 8 (in the form of pins) being routed through the substrate.

The resonant structure in this case can be a continuous rectangular plate which in turn is electrically connected via side surfaces 12, 13 to limbs 3, 4 and at the same time is supported on the substrate. Most simply a piece of sheet metal is cut which allows a surface stretched by limbs 3, 4 to be covered and which is provided with side brackets to form side surfaces 12, 13 (by bending at a right angle). Gap 11 is neither necessary nor desired in this embodiment (mechanical stability).

There can also be a dielectric between the second and third planes. This can be achieved for example by selectively laminating on a dielectric material of a desired layer thickness. Side surfaces 12, 13 can be applied on the corresponding boundary surfaces of the layer which has been laminated on. The plate-shaped resonant structure can be imprinted onto the surface of the layer which had been laminated on.

Figure 2:
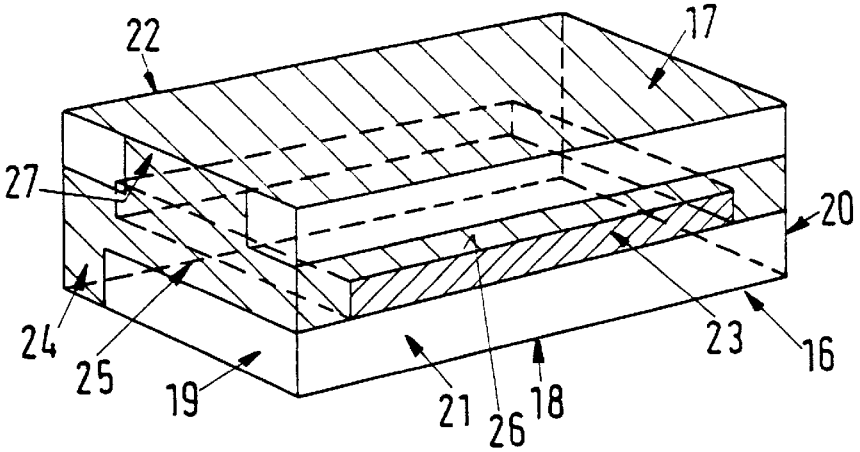
FIG. 2 shows a schematic perspective of an embodiment of the antenna on a ceramic block.
Figure 3:
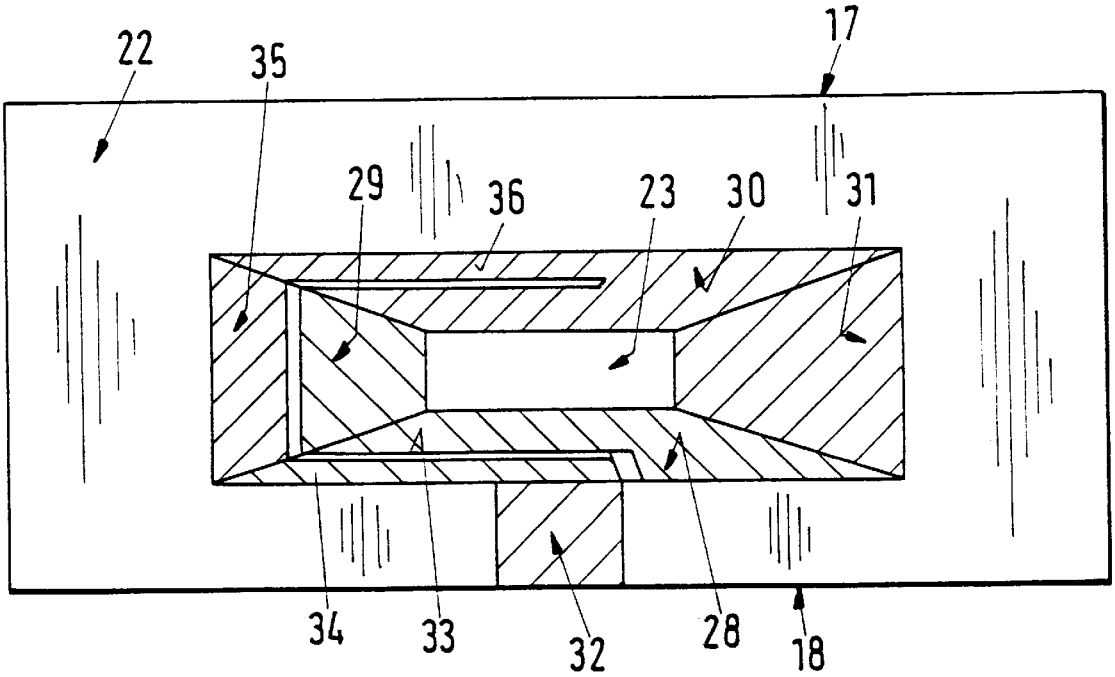
FIG. 3 shows a schematic perspective of the embodiment according to FIG. 2 viewed from the rear.

One especially preferred embodiment will be explained using FIGS. 2 and 3. FIG. 2 schematically shows ceramic block 16. It has top and bottom main surface 17 and 18. On top surface 17 there is metal coating as a resonant structure over the entire surface. Lower main surface 18 can likewise be metal coated (to form, for example, base plate 1 or to be able to solder the ceramic block easily onto a base plate or a metal box).

Ceramic block 16 has two short and two long side surfaces 19, 20 and 21, 22. The slotted divider is formed by there being a continuous strip-like metal coating for forming a printed conductor which runs peripherally in a U-shape on side surfaces 19, 21, 20. This printed conductor is formed by strip-shaped area 25, 26 roughly in the center between two main surfaces 17, 18. On the back end (according to the representation chosen in FIG. 2) of side surface 19 metal coating 24 is routed downward to main surface 18. The electrical connection between the resonant structure and the slot divider is likewise produced by metal coating 27 which is attached on side surface 19. Side surface 20 is selectively metal coated mirror-symmetrically to side surface 19. It is evident that metal coating 24 corresponds to leg 6, metal coating 25 to limb 4, metal coating 26 to middle part 2 and the blanket metal coating of main surface 17 corresponds to two plates 9, 10 in FIG. 1.

What has been lacking until now is a metal coating corresponding to stripline 7. For this reason however there is now flat, continuous slot 23. It extends from side surface 21 to side surface 22 and is for example fully metal coated. For feeding then there can be only one more metal coating 32 which is routed to the bottom from slot 23 on side surface 22 (see FIG. 3). This slot can be attached in the form before hardening or can be produced by drilling. But it is also conceivable that two thin ceramic blocks be joined to form one thick block, the stripline and optionally also the slot divider being formed in a flat version between them.

To bring the input resistance to 50 Ω, it may be necessary to provide an inductance (of for example 1–2 nH) which can be elegantly integrated. One possible version will be explained using FIG. 3. This figure shows ceramic block 16 from behind in an overdrawn perspective representation. Slot 23 has a rectangular cross section and thus four inner surfaces 28, 29, 30, and 31 which are all metal coated. There is (aforementioned) selective metal coating 32 on side surface 22 for feeding. It touches the inner area of slot 23. The inductance is produced by the current being routed first in a loop along slot edge 34, 35, 36 before it can flow in the through direction of slot 23. To do this there is nonconductive line-shaped area 33 which isolates the back end of the slot metal coating. FIG. 3 shows a version in which nonconductive area 33 is isolated for roughly half the width of inner surface 28, the entire width of inner surface 29 and roughly half the width of inner surface 30 from the metal coating in the slot. The current must therefore flow around half the slot periphery; this produces a corresponding inductance. The size of the inductance can be easily varied by appropriately choosing the length of nonconductive area 33.

In principle, inductance can also be forced by corresponding loop routing of the current on side surface 22. This means that the current must first flow a certain amount around the slot before it is routed into it.

In the dielectric the antenna becomes smaller at the same frequency. To optimize the bandwidth which becomes smaller at the same time within physical limits, for example the length of the upper slot (between the second and third plane) can be increased. For preferred applications however there is also enough bandwidth reserve in the dielectric. It must furthermore be watched that the dielectric-induced losses should not be too great. In air the antenna according to this embodiment has a very high efficiency of more than 90%. Ceramic materials with very favorable tanδ values are also known.

Generally the antenna is characterized by a large bandwidth (in air for example 20 to 30%) and by radiation with low or negligibly small power perpendicular to base plate 1. In the direction of the base plate there is a good omnidirectional characteristic.

One important application of the antenna according to the invention is in the area of wireless LANs (for example, HIPERLAN). For this application the antenna can be mounted on a PCMCIA card. Here it is especially advantageous to position two or more antennas of the described type. In this way diversity reception can be accomplished.

To achieve space diversity, several antenna elements are placed next to one another at a certain distance ($\lambda/3$ to $\lambda/2$). (A space diversity effect itself then arises when the antennas touch). One exemplary arrangement of three antennas at a distance of $0.4\lambda$ shows that the antennas have relatively very little mutual influence on one another, i.e., each antenna largely retains its omnidirectional behavior. The signals received from the different antennas are comparatively independent of one another. In the aforementioned exemplary arrangement the antenna system was packed in a volume of $54\times28\times5.2$ mm$^3$ (which corresponds to an extension of the PCMCIA card).

Figure 4:
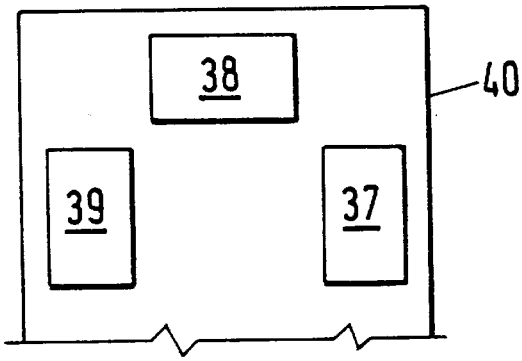
FIG. 4 shows a schematic of an antenna system for achieving diversity reception.

FIG. 4 shows by way of example a U-shaped arrangement of three antenna elements 37, 38, 39 on an extension of PCMCIA card 40. Adjacent antenna elements 37 and 38 and 38 and 39 are each placed at a right angle to one another. For reasons of space, antenna elements 37, 38, 39 (which each are made as shown for example in FIG. 1) are located as near as possible to the corresponding edge of PCMCIA card 40.

To achieve angular diversity two antennas can be set up with the narrow sides (i.e., the bent limbs) directly next to one another.

In this arrangement the two antennas have an angular sensitivity which they do not have as individual antennas (or not in a pronounced form). Depending on from which direction a strong signal is incident, the receiver can be switched to the suitable antenna. The antenna signals can also be advantageously combined. The angular sensitivity can also be rotated as needed by phase rotation of the signal of one antenna compared to that of the other antenna.

The antenna is also suited as the element for so-called antenna arrays. In this case several individual antennas are arranged in isolation or preferably in an association to achieve a desired radiation/reception characteristic by the combination of their signals.

The antennas of the above-described embodiments may also be suitable for hand radiotelephones (cordless phones, GSM handies, etc.). Especially in the ceramic block version, the antenna can be placed as a compact component on the hand to exhibit the desired radiation characteristic. It is even conceivable that the antenna can be designed for receiving two adjacent frequencies (dual frequency mode).

The described antenna has a large number of advantages. In summary the following should be mentioned: large bandwidth, variability of bandwidth, good possibilities for impedance matching, small space requirement, omnidirectional radiation pattern in one plane and no radiation perpendicular to the plane, compatibility with a PCMCIA card (especially also as a system consisting of several antenna elements) and suitability for diversity reception.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A flat three-dimensional antenna comprising:

a conductive base plate arranged in a first plane;

a U-shaped slot divider having a middle part and two side limbs arranged in a second plane; and a resonant structure above the slot divider arranged in a third plane, the two side limbs of the slot divider being shorted to the base plate by legs, the resonant structure being shorted by flank elements to the two side limbs of the slot divider, the flank elements forming a boundary of an antenna slot between the slot divider and the resonant structure.

2. The flat three-dimensional antenna according to claim 1, wherein the slot divider is fed by a stripline which is routed in the second plane between the two side limbs to contact the middle part.

3. The flat three-dimensional antenna according to claim 2, wherein an impedance of the antenna can be matched by varying a width and a length of the stripline.

4. The flat three-dimensional antenna according to claim 1, wherein the resonant structure is cut along a middle portion.

5. The flat three-dimensional antenna according to claim 1, comprising a first antenna slot formed between the base plate and the slot divider, the first antenna slot being larger than the antenna slot formed between the slot divider and the resonant structure.

6. The flat three-dimensional antenna according to claim 5, wherein the bandwidth of the antenna can be changed by varying the antenna slot.

7. The flat three-dimensional antenna according to claim 1, further comprising a dielectric substrate between the first and second planes.

8. The flat three-dimensional antenna according to claim 7, wherein the slot divider is applied as a printed circuit layer on the dielectric substrate, the base plate is formed by a metal coating on a back of the dielectric substrate, and the resonant structure is built up on the printed circuit layer.

9. The flat three-dimensional antenna according to claim 7, wherein the antenna is made on a ceramic block, the slot divider being formed by printed conductors on side surfaces of the ceramic block, the resonant structure being made on a main surface of the ceramic block, and a slot for feeding the antenna being formed in the second plane.

10. The flat three-dimensional antenna according to claim 9, further comprising an inductance integrated into the slot.

11. At least one of the flat three-dimensional antennas of claim 9, in a hand radiotelephone.

12. A plurality of the flat three-dimensional antennas of claim 1, in an antenna array.

13. At least two of the flat three-dimensional antennas of claim 1 in a PCMCIA card for digital communication using space and/or angle diversity reception.

* * * * *